US005729847A

United States Patent [19]

Allardice

[11] Patent Number: 5,729,847

[45] Date of Patent: Mar. 24, 1998

[54] COMBINATION TOP AND BOTTOM BED SHEET AND METHOD FOR CONSTRUCTING THE SAME

[76] Inventor: Andrea K. Allardice, 123 S. Will Scarlet La., Williamsburg, Va. 23185

[21] Appl. No.: 778,756

[22] Filed: Jan. 6, 1997

[51] Int. Cl.[6] ..... A47G 9/02

[52] U.S. Cl. ..... 5/502; 5/494; 5/500

[58] Field of Search ..... 5/494, 498, 499, 5/500, 502

[56] References Cited

U.S. PATENT DOCUMENTS

| | | | |
|---|---|---|---|
| 1,865,329 | 6/1932 | McHorter | 5/500 X |
| 2,637,049 | 5/1953 | Kromer et al. | 5/497 |
| 2,994,094 | 8/1961 | Hester | 5/497 |
| 4,035,854 | 7/1977 | Pardee | 5/497 |
| 4,384,380 | 5/1983 | Galaha et al. | 5/502 X |
| 4,662,013 | 5/1987 | Harrison | 5/497 |
| 5,029,353 | 7/1991 | Kimball | 5/497 |
| 5,375,274 | 12/1994 | Cuneo | 5/497 |
| 5,513,403 | 5/1996 | Wooten, Jr. | 5/497 |

*Primary Examiner*—Michael F. Trettel
*Attorney, Agent, or Firm*—Rhodes, Coats, & Bennett, LLP

[57] ABSTRACT

A combination top and bottom sheet construction. The bottom sheet is comprised of a main section, a pair of side sections, and a foot section. A top sheet includes a main section and a foot end terminal edge. In order to secure the top sheet to the bottom sheet, a pinch stitch is formed transversely across an intermediate portion of the bottom sheet. In particular, a double run formed from the bottom sheet is gathered and the foot end terminal edge of the top sheet is inserted within the double run and the composite double run and foot end terminal end are stitched to form the pinch stitch. An elastic seam is connected about the perimeter of the bottom sheet so as to make the bottom sheet a fitted sheet. Disposed within the lower corner areas of the fitted bottom sheet is a series of bottom panels that are designed to extend diagonally across the lower corner areas of an underlying support structure such as a mattresses.

15 Claims, 7 Drawing Sheets

COMBINATION TOP AND BOTTOM BED SHEET AND METHOD FOR CONSTRUCTING THE SAME

FIELD OF THE INVENTION

The present invention relates to bed sheets and more particularly to a composite top and bottom sheet construction.

BACKGROUND OF THE INVENTION

Combination top and bottom sheets, that is a sheet construction where the top and bottom sheets are connected, are known today. They tend to be especially popular for use in conjunction with RV and air mattresses. This is because these and other similar mattresses are generally light and it is difficult to maintain conventional bed sheets on such mattresses. There are other advantages to combination top and bottom sheets. For example, when making a bed, combination top and bottom sheets are easy to fit on the underlying mattress. Once on the bed, it obviously follows that the top sheet remains attached to the bottom sheet and because of the attachment the top sheet can be easily centered over the bottom sheet. Elderly people also favor combination top and bottom sheets because the top sheet does not require tucking under the mattress. Consequently, lifting the mattress for bed making is eliminated. Also, the top sheet is cut and connected in such a fashion that it neatly drapes over the bed and in a made up state, wears nicely with the bottom sheet as the draping side overhangs can be cut so as to be uniform on both sides of the bed.

As noted above, others have attempted to design a combination top and bottom sheet. For example, see the disclosures found in U.S. Pat. Nos. 5,375,274; 4,924,543; 4,802,251; 3,962,739; and 4,384,380. However, for the most part, these designs have been unsatisfactory. In many cases, the designs have been complex, and have required many cuts, pieces and seams to make a completed combination top and bottom sheet. Secondly and quite importantly, the construction of these top and bottom sheets has been such that the overall appearance of the completed sheet has been less than acceptable to purchasers. Often the many seams, many of which are exposed, and the various panels employed in the combination have given rise to an aesthetic overall appearance that has discouraged purchasers from buying such combination top and bottom sheets.

Another problem with sheet designs, especially bottom sheets, is that the bottom sheets tend to "pop off" the underlying mattress. Again, this is especially true with certain types of mattresses, especially lightweight mattresses and those that do not present a strong rigid structure, and water beds. Fitted bottom sheets with a surrounding elastic seam are in many cases difficult to maintain in a fitted mode on these types of mattresses.

SUMMARY AND OBJECTS OF THE INVENTION

The present invention presents a combination top and bottom sheet that overcomes the problems and drawbacks of combination top and bottom sheets of the prior art. Disclosed herein is a combination top and bottom sheet that is formed of two basic sheet panels, a top sheet and a bottom sheet. To secure the top sheet to the bottom sheet a pinch seam is formed in the bottom sheet such that a foot end terminal edge of the top sheet is sandwiched within the pinched seam. Further, foot corner notches are formed in the foot end of the bottom sheet. These open notches are closed by extending an outer portion of the foot end terminal edge of the top sheet into the open corner areas and stitching the outer portions of the foot end terminal edge with adjacent portions of the bottom sheet. Both the pinch seam and the resulting corner seams are disposed internal or along the underside of the bottom sheet.

In one embodiment of the present invention, the formed fitted bottom sheet is provided with bottom panels that are designed to be inserted underneath corner portions of an underlying support structure such as a mattress. These bottom panels act to secure the fitted bottom sheet onto the underlying support structure or mattress.

It is therefore an object of the present invention to form a combination top and bottom sheet that includes a minimum number of discreet sheet panels and includes a minimum number of seams with the seams being essentially hidden when the combination top and bottom sheet assumes a position on a mattress.

Still a further object of the present invention resides in the provision of a top and bottom combination sheet that is attractive and which fits neatly and smoothly on an underlying mattress.

Another object of the present invention resides in the provision of a fitted bottom sheet that includes bottom corner panels that are designed to extend underneath the corner areas of a mattress so as to secure the bottom sheet to such a mattress.

Other objects and advantages of the present invention will become apparent and obvious from a study of the following description and the accompanying drawings which are merely illustrative of such invention.

DETAILED DESCRIPTION OF THE INVENTION

Figure 1:
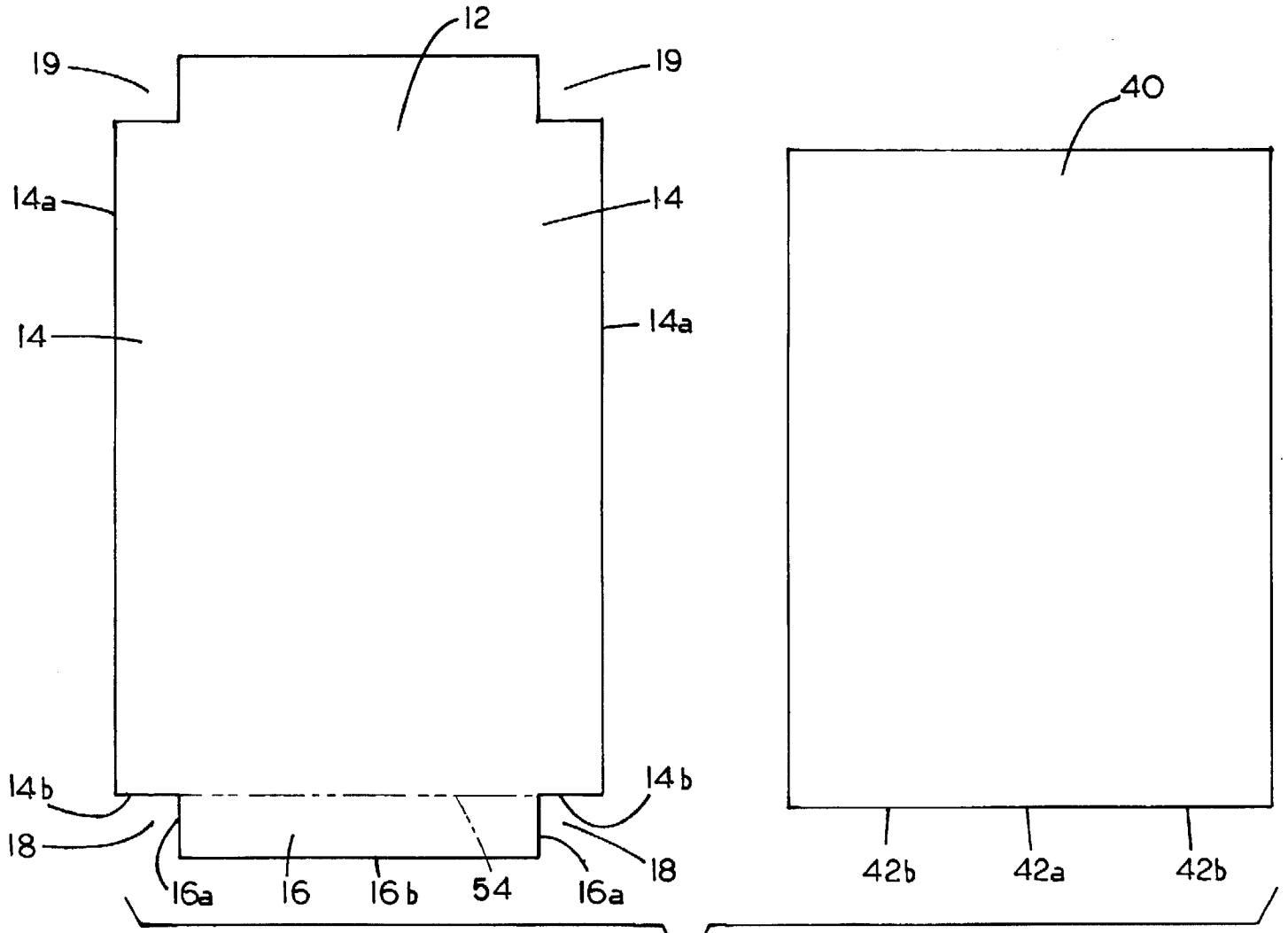
FIG. 1 is a plan view that illustrates the shape and configuration of the top and bottom sheets prior to the same being connected together.

With further reference to the drawings, the combination top and bottom sheet of the present invention is shown therein. In FIG. 1, there is shown a view of the bottom and top sheets in a spreaded planer configuration. First, with respect to the bottom sheet, it is seen that the same includes a main section 12, a pair of side sections 14, and a foot section 16. Each side section 14 includes an outer terminal edge 14*a* and a foot terminal edge 14*b*. Foot section 16 includes a pair of side edges 16*a* and a bottom edge 16*b*. Formed generally between the edge 14*b* of each side section 14 and a side edge 16*a* of the foot section 16 is a corner notch or cutout 18. Likewise, a pair of head cover notches or cutouts 19 are formed about opposite head end portions of the bottom sheet. In the preferred embodiment, the bottom sheet is of a single piece construction.

Extending across the bottom sheet between the main section 12 and the foot section 16 is a reference seam line 54. The significance of reference line 54 is that the same represents the area and location of a seam to be formed by joining the top sheet to the bottom sheet. This will be discussed subsequently in more detail.

Now, turning to the top sheet and again referring to FIG. 1, the same includes a main section 40 and a foot end terminal edge. The foot end terminal edge includes a central portion 42*a* and a pair of outer or flanking portions 42*b*.

To join or connect the bottom sheet with the top sheet, the foot end terminal edge of the top sheet is secured transversely across the bottom sheet. In particular, in the embodiment disclosed herein, the foot end terminal edge including the sections 42*a* and 42*b* are generally aligned with the seam line 54 shown in FIG. 1. Once this alignment occurs, the bottom sheet is connected to the top sheet through a stitched seam.

Figure 2:
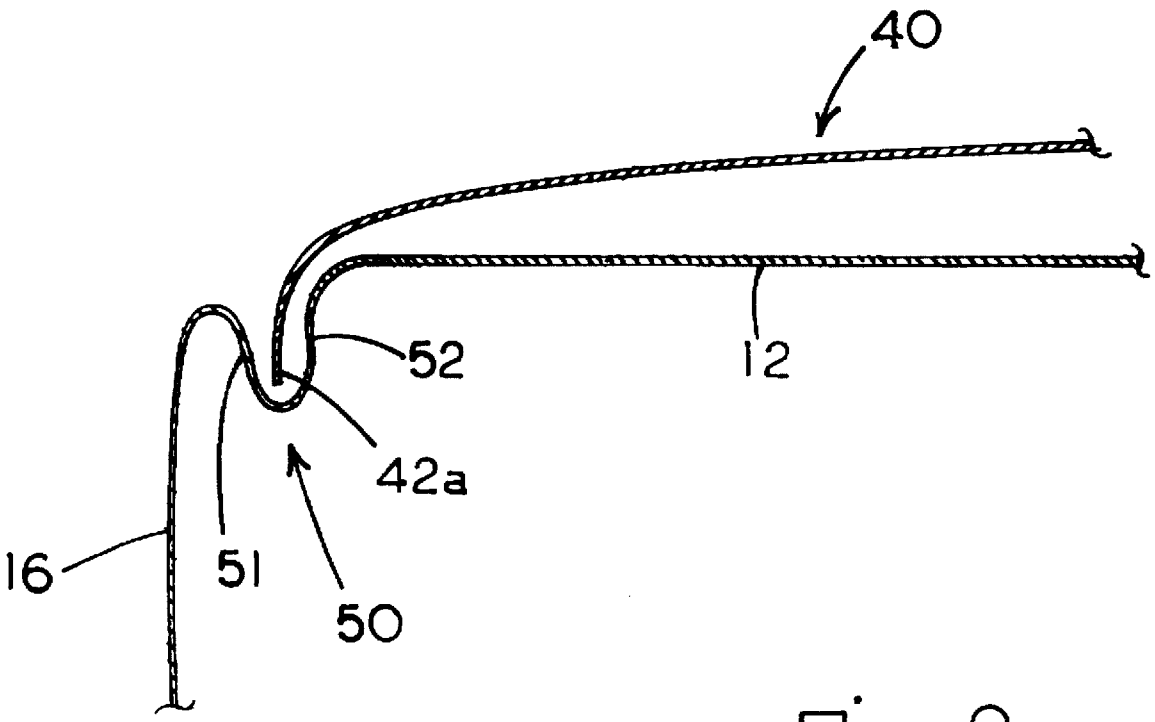
FIG. 2 is a fragmentary longitudinal cross-section of the composite sheet structure of the present invention schematically showing the pinch seam that effectively joins the top and bottom sheets together.
Figure 3:
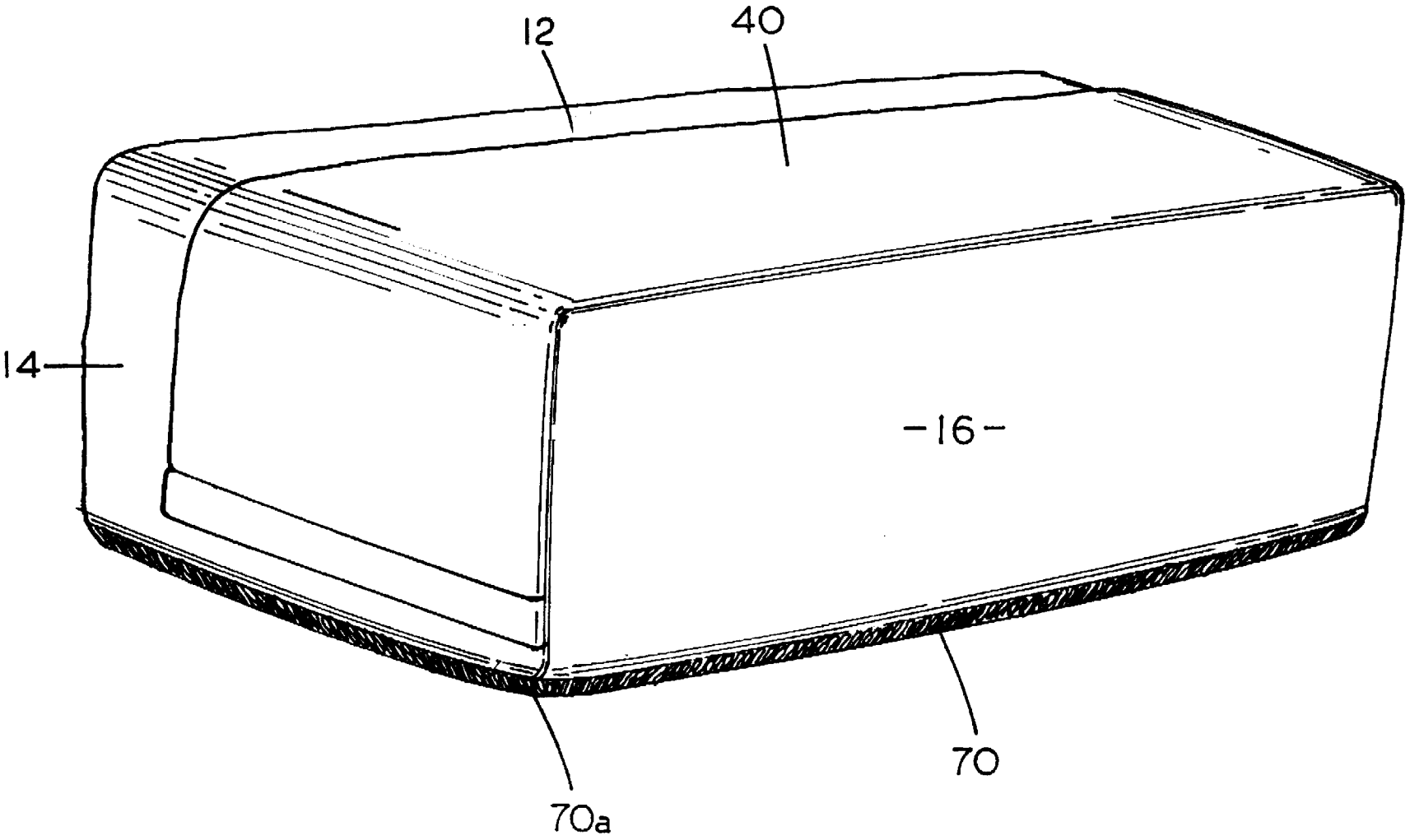
FIG. 3 is a fragmentary perspective view showing a foot end corner portion of the composite sheet structure.

In the embodiment illustrated herein, a pinch stitch, indicated generally by the numeral 50 in FIG. 2, is utilized to effectively stitch and couple the top and bottom sheets together. This is achieved by placing the top sheet over the bottom sheet such that the central portion 42*a* of the foot end terminal edge aligns with the seam line 54. Expressed in another way, the foot end terminal edge of the top sheet is placed over the bottom sheet such that it lies generally between the main section 12 and the foot section 16. Once the top sheet is appropriately placed over the bottom sheet, then the foot panel 16 is flipped over on top of the top sheet and its main panel 40. At this point, it is appreciated that the central portion 42*a* of the foot end terminal edge is located between two runs, referred to by numerals 51 and 52 in FIG. 2, of the bottom sheet. Next, the three-ply construction composed of the doubled or overlapped runs 51 and 52 of the bottom sheet and the terminal edge 42*a* are stitched together by conventional means. This forms the pinch stitch indicated generally by the numeral 50 and again shown particularly in FIG. 2. In FIG. 2, the pinch stitch or seam 50 is shown schematically, that is the seam is shown open. It is appreciated that the seam is closed by conventional stitching that connects and attaches runs 51 and 52 with the edge portion 42*a*.

The formed pinch stitch 50 then lies on the underside of the bottom sheet 12 and is consequently not exposed when the bottom sheet is placed over a mattress. When viewed from the top, the finished seam formed by the terminal edge 42*a* and the bottom sheet is clean and neat since the actual seam or seam proper is disposed on the underside of the bottom sheet.

Figure 4:
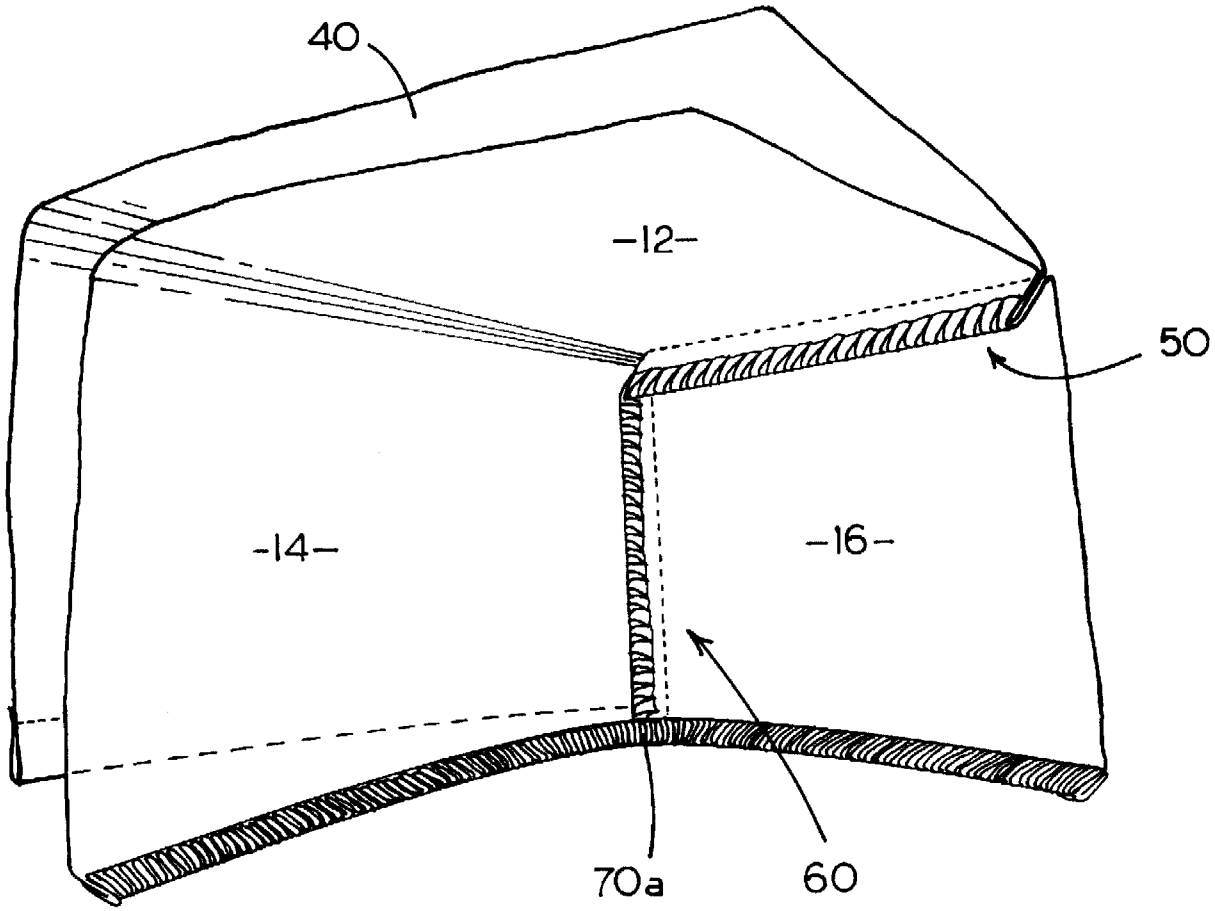
FIG. 4 is a fragmentary perspective view showing an internal area of the composite sheet structure about a foot end corner portion.
Figure 4A:
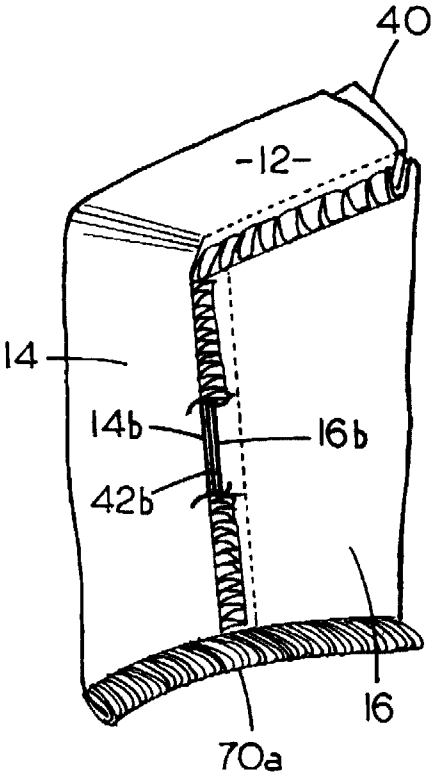
FIG. 4A is a fragementary, perspective view of the interior of a foot corner area showing a portion of a corner seam in cross-section.
Figure 5:
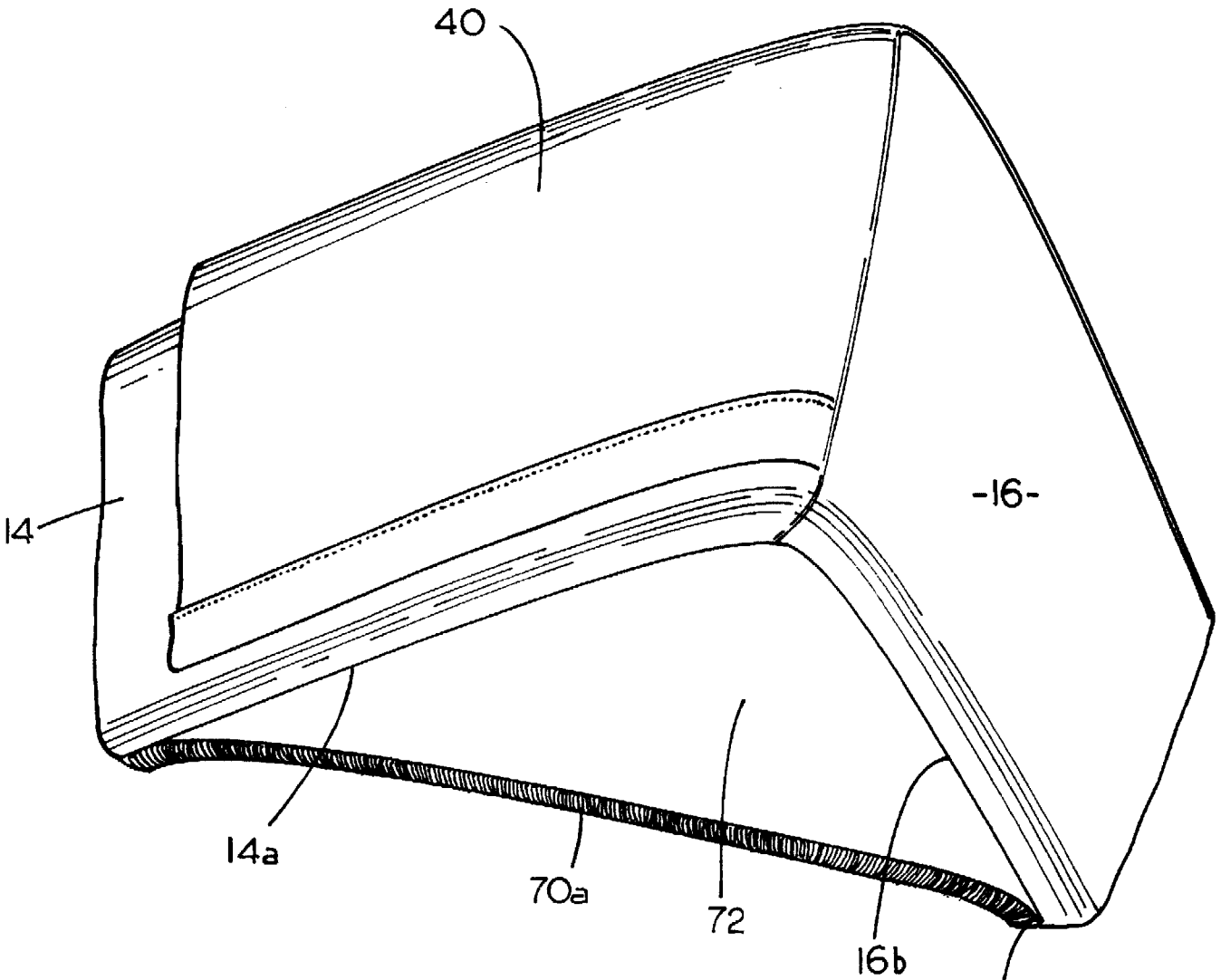
FIG. 5 is a fragmentary perspective view illustrating the bottom panels that are integrated into an alternate composite sheet design which act to underlie a corner portion of a mattress in order to hold the composite sheet thereon.
Figure 6:
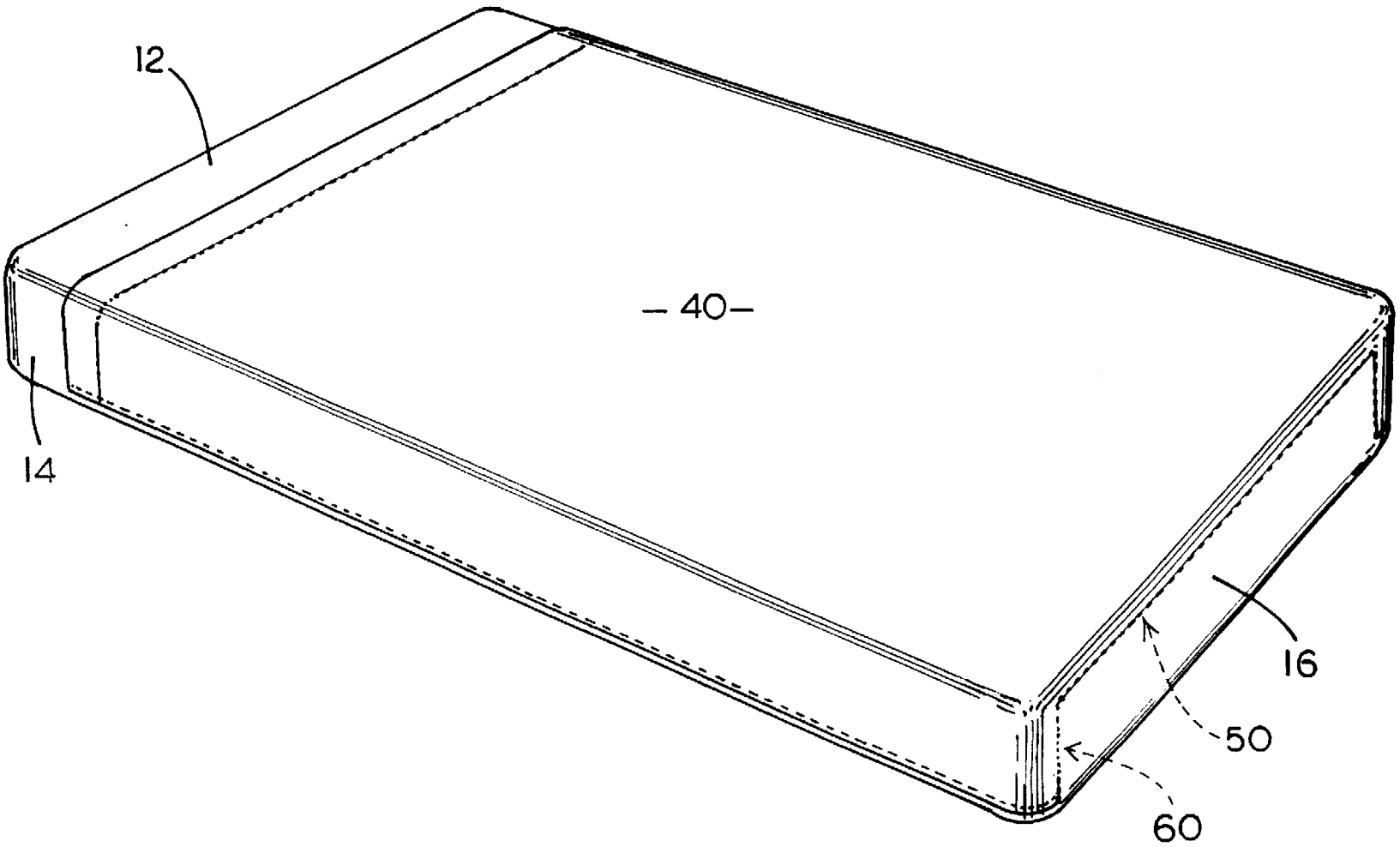
FIG. 6 is a perspective view showing the basic top and bottom sheet composite as the same is fitted onto a mattress.

Note that the pinch stitch or seam 50 only runs generally the width of the foot panel 16. Thus, once the pinch stitch 50 is formed then the outer portions 42*b* of the foot end terminal edge of the top sheet still remain loose and unattached. In the case of the embodiment illustrated herein, the outer sections 42*b* of the foot end terminal edge of the top sheet are integrated with the bottom sheet around the foot corner areas of the composite top and bottom sheet. More particularly, the notched corners 18 are effectively closed by extending and running the outer segments 42*b* between the edges 14*b* and 16*a* (see FIG. 1) of the bottom sheet and joining the respective three edges to form a corner seam indicated generally by the numeral 60 at each foot corner of the bottom sheet. This is particularly illustrated in FIGS. 4 and 4A. Note that the edges 14*b* and 16*a* are brought together and are sandwiched around a respective end segment 42*b* of the foot end terminal edge of the top sheet. Once brought together all three edges or all three plies are stitched together to form the corner seam 60.

The corner seam 60 formed on opposite sides of the foot end of the bottom sheet are like the pinch seam 50 inasmuch as they lie on the underside of the bottom sheet and are not exposed when viewed from the top. It is appreciated that the configuration of the pinch stitch 50 and the two opposed corner stitches 60 form a generally inverted U-shaped seam structure that extends about the foot end portion of the composite top and bottom sheet.

To make the bottom sheet into a fitted sheet, an elastic seam 70 is secured about the outer perimeter of the bottom sheet. More particularly, the elastic seam 70 runs along the lower edge 16*b* of the foot panel 16 and connects to the outer terminal edge 14*a* of the side sections 14. Moreover, the elastic seam 70 continues around the head portion of the lower sheet to form a continuous elastic seam around the perimeter of the bottom sheet.

As indicated in the drawings, particular FIGS. 3–5 and 7, the elastic seam 70 extends around each of four corner areas defined around the formed fitted bottom sheet. At each corner area, the elastic seam includes a corner segment 70*a* that curves around the corner perimeter of the bottom sheet.

Figure 7:
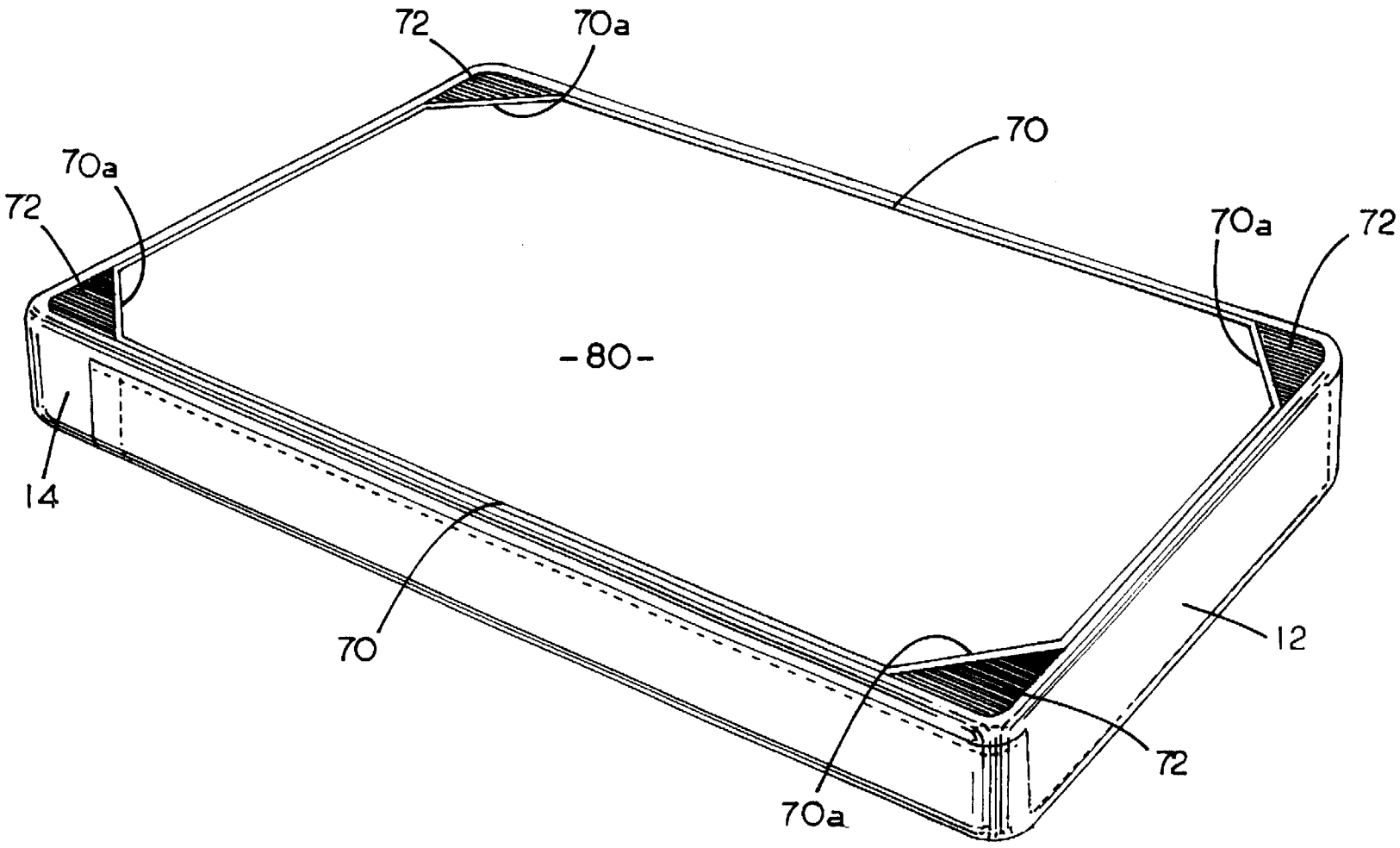
FIG. 7 is a perspective view of the underside of a mattress having the composite sheet structure fitted thereon and particularly illustrating the bottom panels that are utilized to secure an alternate design for the composite sheets onto a mattress.

Formed in the fitted bottom sheet about each corner portion is a bottom panel 72. Bottom panel 72 is particularly illustrated in FIGS. 5 and 7. As seen in the drawings, the bottom panel 72 is connected to the corner segment 70*a* of the elastic seam 70 and extends generally inwardly therefrom where the bottom panel attaches to adjacent panels or sections of the bottom sheet. In particular, in the embodiment disclosed herein, the bottom panels 72 are generally triangular and are stitched between a respective corner segment 70*a* of the elastic seam 70 and a side section 14 and a foot section 16 of the bottom sheet. Once the bottom sheet is fitted on an underlying support structure or mattress 80 as illustrated in FIG. 7, the bottom panels 72 extend generally diagonally across the corner areas of the mattress 80. Thus, bottom panels 72 positively secure the fitted bottom sheet and consequently the composite top and bottom sheet to the mattress 80. The bottom panels 72 disclosed herein form a part of an alternate embodiment of the composite top and bottom sheet. That is, they are not required in all constructions of a combination top and bottom sheet. However, bottom panels 72 are extremely beneficial when used in connection with lightweight mattresses or waterbeds.

It is therefore appreciated that the present invention presents a composite bottom and top sheet where the top sheet is secured to the bottom sheet in such a fashion that all seams are disposed underneath the bottom sheet out of sight when the composite bottom and top sheet are fitted over a mattress 80. As viewed from the foot end of a bed, it is seen that the composite top and bottom sheet present a very neat and compact design without any evidence of the presence of stitched seams. When viewed from the foot end, it is seen that the foot section 16 of the bottom sheet is exposed and that the top sheet is only attached and project from the point of the pinch seam 50 forward. Expressed in another way, the top sheet actually terminates about the foot end line of the mattress. However, the top sheet through its outer foot end terminal edges **42*b*, forms a part of the corner stitches 60 that join the foot section 16 with the two side sections 14. Thus, the entire composite top and bottom sheet is made and constructed of the two panels illustrated in FIG. 1** and the seams that join the two panels together is found internally or underneath the bottom sheet out of view when the composite sheets are disposed on a bed in a made-up fashion.

The present invention may, of course, be carried out in other specific ways than those herein set forth without parting from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. A combination top and bottom sheet comprising:

a) a bottom sheet having a main section, a pair of side sections, a foot section, a pair of head corner cutouts, and a pair of foot corner cutouts formed generally between the foot section and the respective side sections;

b) a top sheet including a foot end terminal edge having a central run and a pair of outer runs;

c) a pinch stitch for connecting the central run of the foot end terminal edge to the bottom sheet, the pinch stitch including doubling the bottom sheet over the central run of the foot end terminal edge of the top sheet and stitching the same so as to effectively sandwich the foot end terminal edge of the top sheet between the two overlapping runs of the bottom sheet;

d) corner stitches for closing the two foot corner notches, each corner stitch including a stitch seam that connects an outer run of the foot end terminal edge of the top sheet with a portion of the adjacent side section and foot section of the bottom sheet; and e) a continuous elastic seam connecting the foot panel with the respective side sections of the bottom sheet to form a fitted bottom sheet.

2. The combination top and bottom sheet of claim 1 wherein the pinch stitch generally extends between the main section and the foot section of the bottom sheet.

3. The combination top and bottom sheet of claim 1 wherein the bottom includes a top side and an under side and wherein the pinch stitch forms an internal seam that is exposed along the underside of the bottom sheet.

4. The combination top and bottom sheet of claim 1 wherein the pinch stitch and the corner stitches form a generally U-shaped seam line about an underside of the bottom sheet.

5. The combination top and bottom sheet of claim 1 wherein the formed bottom sheet includes a series of corner areas with the elastic seam including corner segments that extend around the corner areas and wherein there is provided bottom panels connected to and extend adjacent the corner segments of the elastic seam, the bottom panels adapted to extend across the underside of corner sections of an underlying support structure having the bottom sheet fitted thereon.

6. The combination top and bottom sheet of claim 5 wherein the bottom panels formed adjacent the foot section of the bottom sheet are stitched to adjacent portions of the foot section and side sections as well as to an adjacent portion of the corner segment of the elastic seam.

7. The combination top and bottom sheet of claim 5 wherein the bottom panels form generally diagonal panels when extending underneath an underlying support structure.

8. A combination top and bottom sheet comprising: a fitted bottom sheet having a main section, an outer perimeter, and an elastic seam secured to the outer perimeter; a top sheet having a foot end terminal edge; a pinch stitch formed between the top and bottom sheets for connecting the top and bottom sheets; and wherein the pinch stitch includes a double run of the bottom sheet with the foot end terminal edge being inserted between the double run and wherein the double run and foot end terminal edge are stitched to form the pinch stitch.

9. The combination top and bottom sheet of claim 8 wherein the bottom sheet includes upper and lower sides and wherein the pinch stitch forms an internal seam that is only exposed along the lower side of the bottom sheet.

10. The combination top and bottom sheet of claim 9 wherein the foot end terminal edge of the top sheet extend outwardly from each side of the pinch stitch and connects with portions of the bottom sheet to form closed corner stitches for the fitted bottom sheet.

11. The combination top and bottom sheet of claim 8 wherein the elastic seam includes a series of corner segments that extend around corner portions of the bottom fitted sheet and wherein there is provided a bottom panel secured adjacent each respective segments and which lies underneath an underlying support structure such as a mattress when the bottom fitted sheet is placed on the underlying support structure.

12. The combination top and bottom sheet of claim 11 wherein the respective bottom panels extend inwardly from the corner segments of the elastic seam and are stitched to portions of the bottom sheet such that each respective bottom panel is effectively inserted between a corner segment of the elastic seam and the bottom sheet.

13. A method of forming a top and bottom sheet comprising the steps of: connecting a top sheet to a bottom sheet by pinching the bottom sheet along a transverse run and inserting an edge portion of the top sheet within the pinched portion of the bottom sheet and then stitching the pinched run of the bottom sheet and the edge portion of the top sheet together such that the formed stitched seam lies underneath the bottom sheet.

14. The method of claim 13 including extending the edge portion of the top sheet outwardly from the stitched pinched seam and stitching the extended edge portion on both sides of the stitched pinched seam to portions of the bottom sheet to form stitched corner portions such that the edge portion of the top sheet forms a part of foot corner seams of the composite top and bottom sheet.

15. The method of claim 13 wherein the bottom sheet includes a foot panel and wherein the edge portion of the top sheet is placed intermediately across the bottom sheet and wherein the foot panel is flipped over the top sheet so as to pinch the edge portion of the top sheet between two runs of the bottom sheet and thereafter stitching the two runs of the bottom sheet together along with the edge portion of the top sheet held between the two runs.

* * * * *